US006591626B2

(12) United States Patent
Cheng et al.

(10) Patent No.: US 6,591,626 B2
(45) Date of Patent: Jul. 15, 2003

(54) WATER REMOVAL DEVICE FOR REFRIGERATION SYSTEM

(75) Inventors: Wei-Yueh Cheng, Hsin Chu Hsien (TW); Shih-Pei Lin, Hsin Chu Hsien (TW)

(73) Assignee: Industrial Technology Institute, Hsien (TW)

( * ) Notice: Subject to any disclaimer, the term of this patent is extended or adjusted under 35 U.S.C. 154(b) by 0 days.

(21) Appl. No.: 10/021,251

(22) Filed: Dec. 19, 2001

(65) Prior Publication Data

US 2003/0110790 A1 Jun. 19, 2003

(51) Int. Cl.[7] ..... F25D 21/00

(52) U.S. Cl. ..... 62/272; 62/80; 62/275; 62/283

(58) Field of Search ..... 62/272, 275, 283, 62/80, 150, 158

(56) References Cited

U.S. PATENT DOCUMENTS 3,807,489 A * 4/1974 Minbiole et al. ..... 165/1
4,651,806 A * 3/1987 Allen et al. ..... 165/1
6,298,679 B1 * 10/2001 Cheng et al. ..... 62/275
6,332,331 B1 * 12/2001 Cheng et al. ..... 62/275
6,374,909 B1 * 4/2002 Jeter et al. ..... 165/96
6,397,619 B1 * 6/2002 Cheng et al. ..... 62/272

FOREIGN PATENT DOCUMENTS

JP 406317366 A * 11/1994 ..... 62/272

* cited by examiner

*Primary Examiner*—Melvin Jones
(74) *Attorney, Agent, or Firm*—Bacon & Thomas, PLLC

(57) ABSTRACT

A water removal device for refrigeration system comprises an electrode and a voltage source; the voltage source provides voltage for the electrode, which is located under the evaporator of the refrigeration system. Through the electric effect produced by the electrode, the condensed water condensed on the evaporator can be swiftly removed, a result that thoroughly takes advantage of the heat transfer function of the evaporator. In addition, there shall not be any electricity-discharging sparks between the electrode and the evaporator, thus assuring the normal operation of the refrigeration system.

8 Claims, 4 Drawing Sheets

WATER REMOVAL DEVICE FOR REFRIGERATION SYSTEM

BACKGROUND OF THE INVENTION

Summary of the Invention

The present invention relates to a water removal device for refrigeration system, more particularly, an evaporator designed by using the method of electrohydrodynarnics (EHD) in refrigeration system, a device that swiftly removes the condensation water, which is of polar molecule, on the evaporator through the influence of the electric effect, thus enhancing the water removal function.

DESCRIPTION OF RELATED ART

FIG. 5 shows the cycling circuit of a conventional refrigeration system like an air conditioner or a dehumidifier, which usually comprises a compressor 11, a condenser 12, an expansion valve 13 and an evaporator 14, wherein the compressor 11 compresses the low-temperature gaseous refrigerant into a high-pressure and high-temperature gaseous refrigerant, which, exchanging heat with the outer fluid via the condenser 12, is to be condensed into a high-pressure and mid-temperature liquid refrigerant; and then, such high-pressure and mid-temperature liquid refrigerant is to flow through the fin-pipe type evaporator 14 to absorb the outer heat so as to produce a cold chamber effect; finally, the low-pressure and mid-temperature liquid refrigerant will become a low-pressure and low-temperature gaseous refrigerant inside the evaporator 14; thus the whole refrigerant cycle is completed.

The main structure of the fin-pipe type evaporator 14 includes a zigzag type of copper pipe used for carrying refrigerant, a plurality of fins closely attached to the copper pipe, and a fan to provide air flow; the fins are used for increasing the heat-exchanging area of the evaporator 14. The fan is used for blowing air to flow among the fins so as to provide heat exchange between the fins and the copper pipe. Since the fins and the copper pipe have a considerable low temperature, the moisture in the air will be condensed on the fins; as soon as the moisture is condensed to a given weight, it will drop and flow to the bottoms of the fins to be drained, wherein most of the draining process of the condensed water is to be done at the bottoms of the fins.

Nevertheless, since the spacing between the fins is extremely congested, the aforementioned process of using gravitational force to drain off the condensed water becomes considerably slow, thus the condensed water that is to be drained off slowly shall curb the air flow passage, increase the wind resistance force, and decrease the volume of air flow; eventually the workload of the fan motor shall damage the heat-transferring function of the evaporator, thus adversely affecting the operational efficiency of the overall system.

For the purpose of energy saving, developing smaller, more efficient and energy-saving refrigeration system is the ongoing trend up to now, a goal that can be furthered achieved by shortening the attaching time of the condensed water on the evaporator.

The R.O.C. U.S. Pat. No. 159,545, owned by the Applicant, relates to a water removal device for refrigeration system that is designed for shortening the attaching time of the condensed water on the evaporator. The U.S. Pat. No. 159,545 utilizes the EHD technique which, through the electric effect produced by the positive and negative electrodes, swiftly removes the condensed water condensed on the evaporator of the refrigeration system, thus thoroughly taking advantage of the heat transfer function of the evaporator, and increasing the operational efficiency of the overall system.

Furthermore, the R.O.C. U.S. Pat. No. 159,545 not only comprises the conventional cycling circuit that includes a compressor 11, a condenser 12, an expansion valve 13 and an evaporator 14, but it mainly includes also a base plate 32 that, mounted at the bottom of the evaporator 14, can be of metal conductive wire or other conductive material. In addition, such base plate 32 is to be connected with a positive high-voltage generator 33 to produce the positive pole. At the same time, the evaporator 14 is to be connected with a negative high-voltage generator 31, thus making the evaporator 14 a negative pole, shown in FIG. 6.

The positive and negative high-voltage continuous-current generators 33 and 31 are devices that utilize the flyback transformers and related circuits to produce high-voltage low electric current, and these two generators 33 and 31 respectively connect the base plate 32 and the evaporator 14 to form an electric field. Since water is a high dielectric constant material, the condensed water formed on the evaporator 14 is charged with negative electricity by the evaporator 14. Therefore, the electrified negative condensed water, gravitated by the electric field containing positive and negative electricity, is to be attracted by the base plate 32 containing positive electricity, thus is pulled away from the evaporator 14, and then the condensed water is to drip down to the bottom and is drained. Principally, the stronger the influence of the electric field is, the more effective the draining of the condensed water will be. However, the R.O.C. U.S. Pat. No. 159,545, when being actually applied, shall cause electricity-discharging sparks or short circuit, for the positive and negative electricity high voltage become too high, or the distance of the positive and negative electricity between the base plate 32 and the evaporator is too short, a result that would seriously affect the normal operation of the whole system.

SUMMARY OF THE INVENTION

The main object of the present invention is to provide a water removal device for refrigeration system; by installing under the evaporator an electric pole connecting the voltage source, the condensed water of polar molecule is to be pulled away from the evaporator by the electric field, thus effectively overcoming the drawbacks of producing electricity-discharging sparks to affect the normal operation of the whole system caused by the conventional art, thoroughly taking advantage of the electricity-conducting function of the evaporator, and assuring the normal operation of the refrigeration system.

Another object of the present invention is to provide a water removal device for refrigeration system; by installing a time controller to control the electricity supply cycle of the voltage source, and a controlling unit to control the time controller and the voltage source, thus creating an electricity-saving device to save energy during the condition of not having much condensed water to be drained.

The aforementioned objects are to be achieved by a water removal device for refrigeration system comprising an electrode, mounted under the evaporator, and a voltage source, connected to the electrode for providing voltage to the electrode; between the electrode and the evaporator an electric potential difference is formed to create an electric field, thus the condensed water, being of polar molecule from the evaporator, is to be attracted by the electric field and therefore to be pulled away swiftly. There will be no electricity-discharging sparks between the evaporator and the electrode, The aforementioned electric field can be either positive or negative electric field; when the electric field is a positive field, the electrode then is to be positive and the voltage source is to be a positive voltage source also; when the electric field is a negative field, the electrode then is to be negative and the voltage source is to be a negative voltage source as well.

BRIEF DESCRIPTION OF THE DRAWINGS

These and other features, aspects and advantages of the present invention will become better understood with regard to the following description, appended claims and accompanying drawings where.

DETAILED DESCRIPTION OF THE PREFERRED EMBODIMENT

Figure 1:
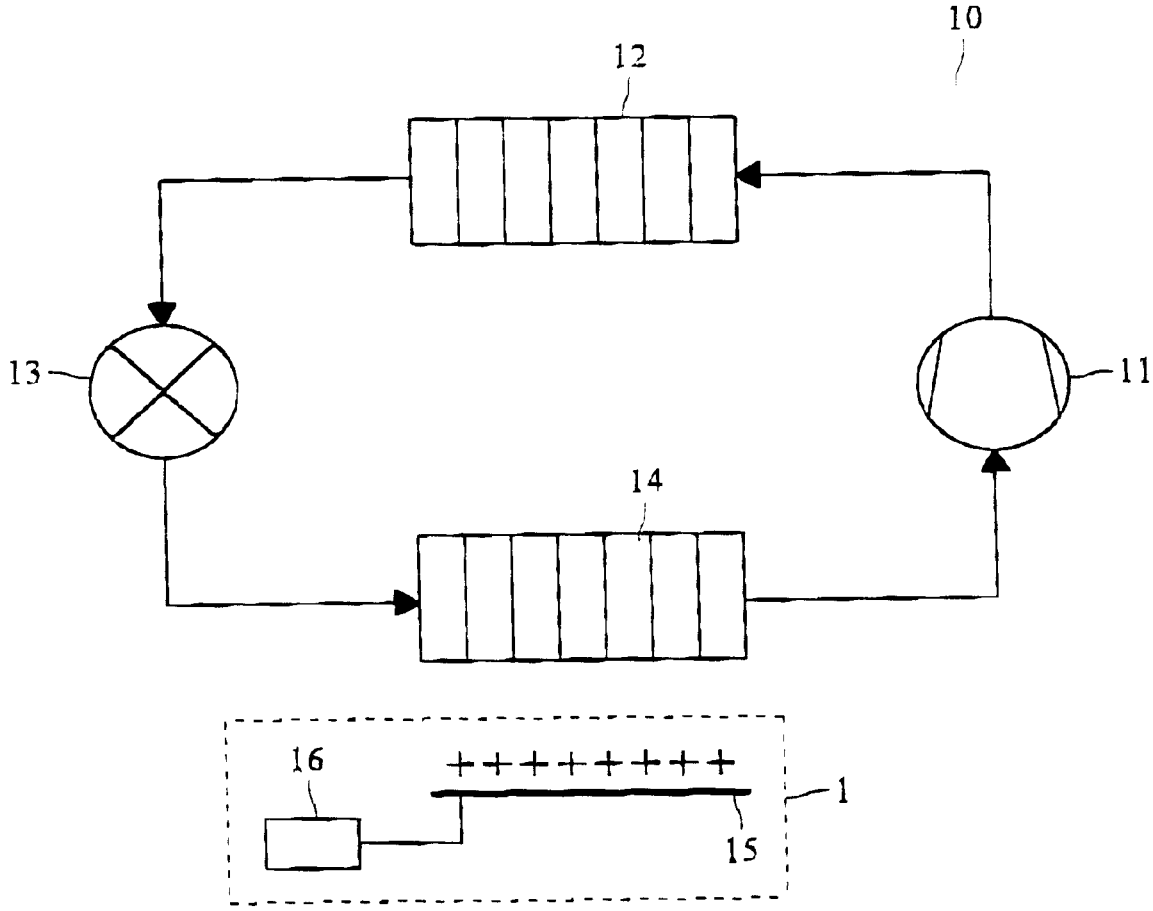
FIG. 1 shows a structural view of a water removal device for refrigeration system of the present invention.

As shown in FIG. 1, the water removal device 1 of the present invention mainly includes an electrode 15 and a voltage source 16, wherein the electrode 15 can be of metal wire, metal rod, metal plate or other electricity-conductive material; in the embodiment of the present invention, the electrode 15 is a positive electrode. The voltage source 16 utilizes the flyback transformer and related circuits to produce high-voltage low electric current device; in the embodiment of the present invention, the voltage source 16 is a positive voltage source. The positive voltage source 16 connects to the positive electrode 15 for providing the positive voltage to the positive electrode 15. The positive electrode 15 is located under the evaporator 14 of the refrigeration system 10 that comprises a compressor 11, condenser 12, an expansion valve 13 and the evaporator 14.

The refrigeration system 10, like the conventional art, utilizes the compressor 11 to compress the low-temperature gaseous refrigerant into a high-pressure and high-temperature gaseous refrigerant, which, exchanging heat with the outer fluid via the condenser 12, is to be condensed into a high-pressure and mid-temperature liquid refrigerant; and then, such high-pressure and mid-temperature liquid refrigerant is to flow through the fin-pipe type evaporator 14 to absorb the outer heat so as to produce a cold chamber effect; finally, the low-pressure and mid-temperature liquid refrigerant will become a low-pressure and low-temperature gaseous refrigerant inside the evaporator 14; thus the moisture in the air shall be condensed on the evaporator 14 to form the condensed water.

Because in the water removal device 1 of the present invention, the positive electrode 15, mounted under the evaporator 14, connects to the positive voltage source 16 that generates positive voltage, an electric field is formed out of the electric potential difference produced between the positive electrode 15 having positive electricity and the evaporator 14. In addition, since the condensed water on the evaporator is of polar molecule, it is to be swiftly pulled away by the attraction of the positive electric field, thus achieving the goal of draining the condensed water away. Furthermore, it is no need for the evaporator 14 to be connected to the negative high voltage, and there shall not be any sparks discharging electricity to adversely affect the normal operation of the system between the evaporator 14 and the positive electrode. As previously mentioned, since the condensed water is of polar molecule, not only can it be swiftly pulled away by the attraction of the positive electric field, but it can also be swiftly pulled away by the attraction of the negative electric field. Moreover, the aforementioned positive electrode 15 can be a negative electrode, along with the positive voltage source being a negative voltage source correspondingly, thus providing the negative voltage needed by the negative electrode; then between the negative electrode and the evaporator 14, an electric potential difference is formed to produce negative electric field, therefore the condensed water on the evaporator 14 is to be swiftly pulled away by the attraction of the negative electric field, achieving the goal of water removal.

Considering the condition that there might not be much condensed water from time to time, it is no need for the water removal device to operate all the time in terms of energy saving, thus an electricity-saving device 2 is included in the water removal device 1 of the present invention to achieve the goal of energy saving.

Figure 2:
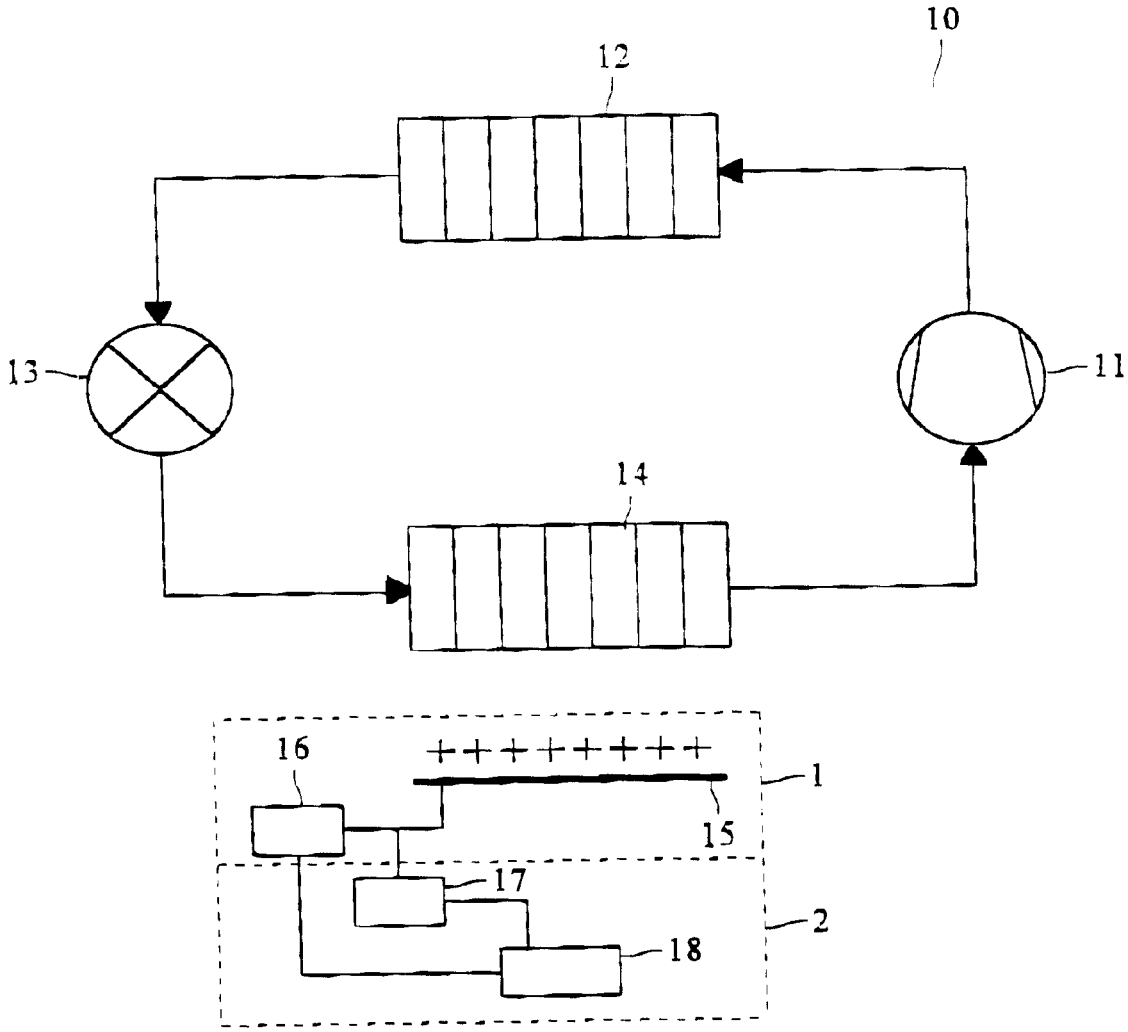
FIG. 2 shows a structural view of an electricity-saving device in a water removal device for refrigeration system of the present invention.
Figure 3:
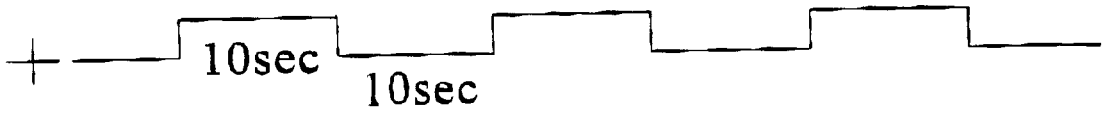
FIG. 3 shows an oscillogram for the voltage alteration cycle of the positive voltage source of the electricity-saving device in FIG. 2.
Figure 4:
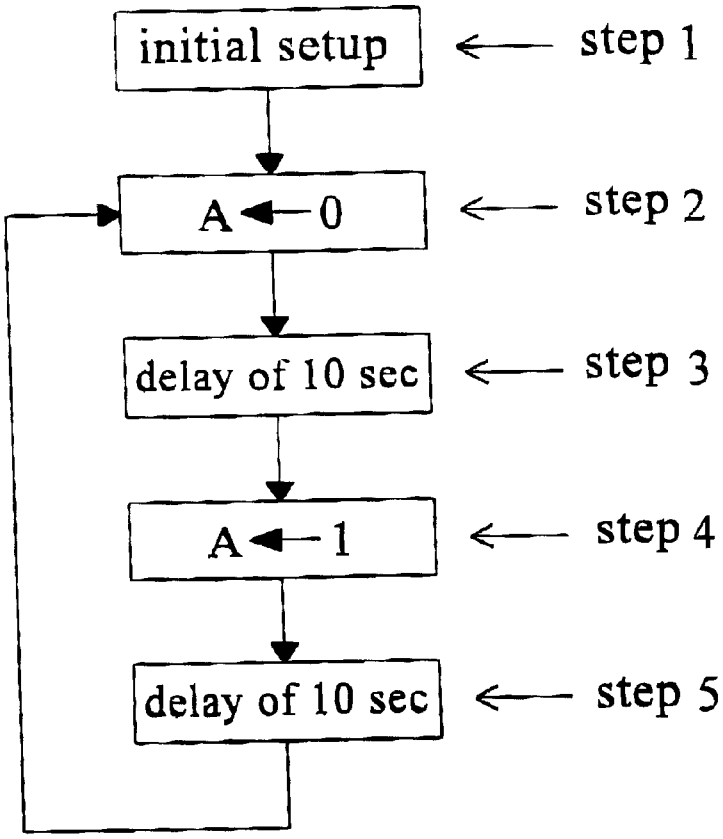
FIG. 4 shows a control flowchart of the electricity-saving device in FIG. 2.
Figure 5:
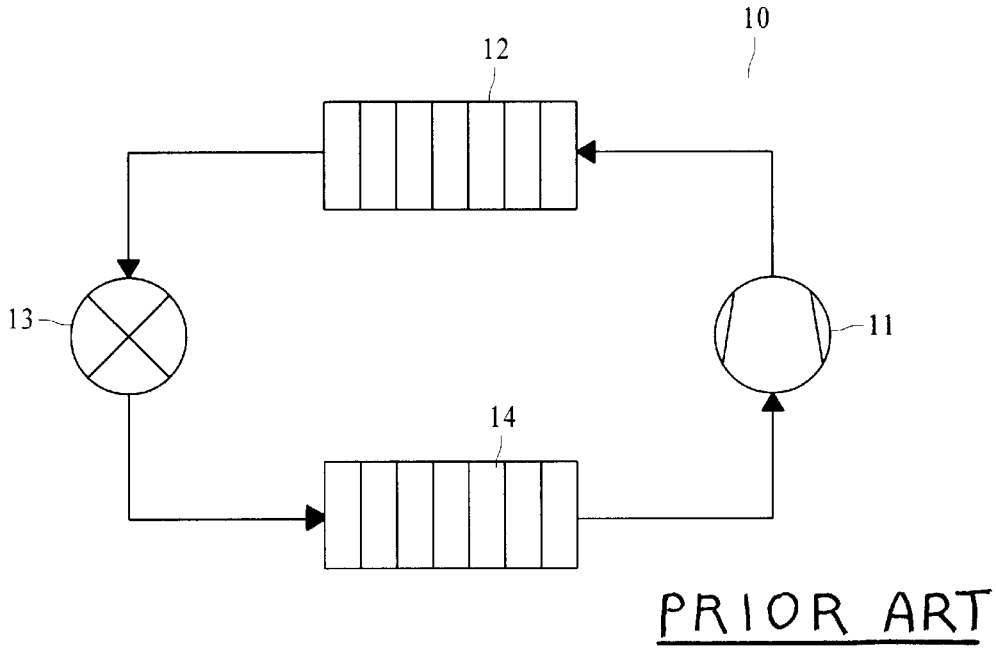
FIG. 5 shows a structural view of a general refrigeration system.
Figure 6:
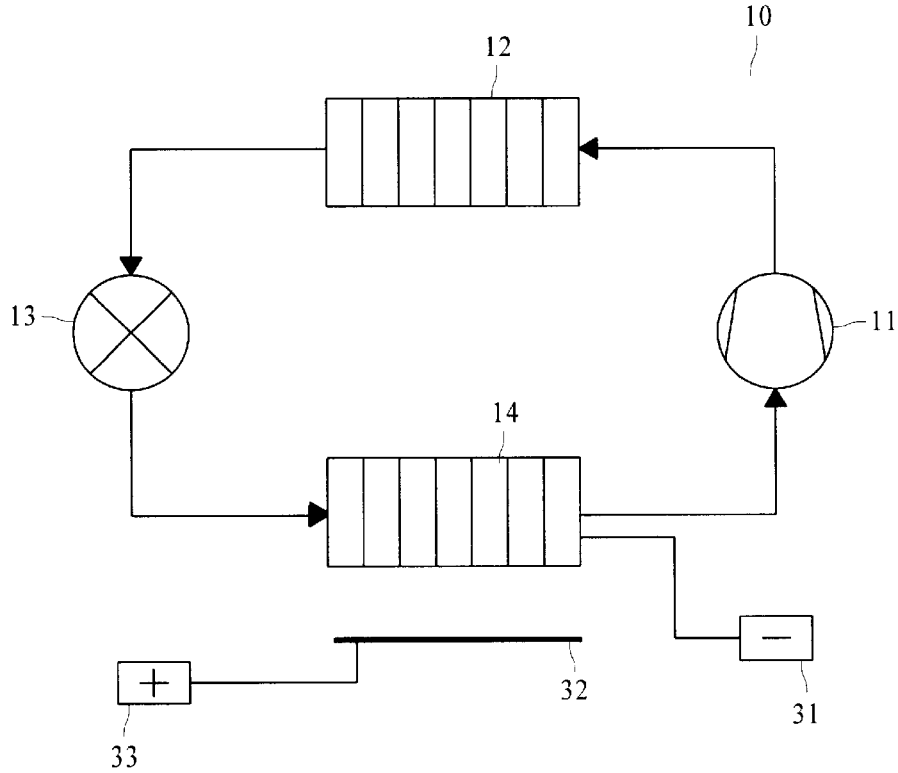
FIG. 6 shows a structural view of the New Utility Model Pat. No. 159,545.

FIG. 2 shows the composition of the electricity-saving device 2; the electricity-saving device 2 includes a time controller 17 and a controlling unit 18, wherein the time controller 17 is for controlling the electricity supply cycle of the positive voltage source 16, and the controlling unit 18 is for controlling the working of the time controller 17 and the positive voltage source 16. Please refer to FIG. 3, showing the cyclical voltage alteration made by the time-controller 17 controlling and switching the positive voltage source 16. In this embodiment, the voltage alteration cycle is 10 seconds, which can be adjusted according to various needs. Please further refer to FIG. 4, which shows the controlling process of the controlling unit 18; this embodiment includes five steps listed as follows: step 1 is an initial setup; step 2 sets up the output value of the wave form A as zero; step 3 is the delay of ten seconds; step 4 sets up the output value of the wave form A as one; step 5 is the delay of ten seconds. And then the process returns to step 2 to repeat the working of the next cycle.

Although the present invention has been described in considerable detail with reference to certain preferred embodiments thereof, those skilled in the art can easily understand that all kinds of alterations and changes can be made within the spirit and scope of the appended claims. Therefore, the spirit and scope of the appended claims should not be limited to the description of the preferred embodiments contained herein.

What is claimed is:

1. A water removal device for refrigeration system, comprising:

an electrode, mounted under an evaporator of said refrigeration system; and a voltage source, connected to said electrode to provide electricity for said electrode;

wherein, the electric potential difference is formed between said electrode and said evaporator to create an electric field, thus condensed water on said evaporator shall be pulled away by the attraction of said electric field, without having electricity-discharging sparks between said evaporator and said electrode.

2. A water removal device for refrigeration system, comprising:

an electrode, mounted under an evaporator of said refrigeration system;

a voltage source, connected to said electrode to provide electricity for said electrode; and an electricity-saving device;

wherein, the electric potential difference is formed between said electrode and said evaporator to create an electric field, thus condensed water on said evaporator shall be pulled away by the attraction of said electric field, without having electricity-discharging sparks between said evaporator and said electrode; said electricity-saving device is mounted for controlling the voltage alteration cycle of said voltage source, thus saving energy during the condition of not having much condensed water to be drained.

3. A water removal device for refrigeration system as in claim 1 or 2, wherein said electrode is a positive electrode and said voltage source is a positive voltage source.

4. A water removal device for refrigeration system as in claim 1 or 2, wherein said electrode is a negative electrode and said voltage source is a negative voltage source.

5. A water removal device for refrigeration system as in claim 1 or 2, wherein said electrode is of metal wire, metal rod, metal plate or other conductive material.

6. A water removal device for refrigeration system as in claim 2, wherein said electricity-saving device is comprised of a time controller and a controlling unit.

7. A water removal device for refrigeration system as in claim 6, wherein said time controller is used for controlling the electricity supply cycle of said voltage source.

8. A water removal device for refrigeration system as in claim 6, wherein said controlling unit is used for controlling the working of said time controller and said voltage source.

* * * * *